United States Patent [19]

Kobayashi et al.

[11] Patent Number: 4,815,876

[45] Date of Patent: Mar. 28, 1989

[54] PRINTER

[75] Inventors: Shogo Kobayashi; Kenichi Tsumuraya; Kazuhiro Horie, all of Tokyo, Japan

[73] Assignee: Seikosha Co., Ltd., Tokyo, Japan

[21] Appl. No.: 162,067

[22] Filed: Feb. 29, 1988

[30] Foreign Application Priority Data

Feb. 27, 1987 [JP] Japan ..... 62-28641[U]

[51] Int. Cl.[4] ..... B41J 11/48

[52] U.S. Cl. ..... 400/603.1; 400/693

[58] Field of Search ..... 400/605, 603.1, 595, 400/603, 578, 693

[56] References Cited

U.S. PATENT DOCUMENTS

| | | | |
|---|---|---|---|
| 2,226,151 | 12/1940 | Anderson | 400/603.1 |
| 4,619,388 | 10/1986 | Kawaguchi | 400/605 |
| 4,662,765 | 5/1987 | Kapp et al. | 400/603.1 |
| 4,668,960 | 5/1987 | Okamura | 400/605 |
| 4,725,157 | 2/1988 | Nakal et al. | 400/693 |
| 4,732,501 | 3/1988 | Angst et al. | 400/605 |

FOREIGN PATENT DOCUMENTS

| | | | |
|---|---|---|---|
| 3208111 | 9/1983 | Fed. Rep. of Germany | 400/605 |
| 208274 | 10/1985 | Japan | 400/693 |
| 141577 | 6/1986 | Japan | 400/693 |
| 202871 | 9/1986 | Japan | 400/605 |
| 2177348 | 1/1987 | United Kingdom | 400/693 |

*Primary Examiner*—E. M. Eickholt

*Attorney, Agent, or Firm*—Bruce L. Adams; Van C. Wilks

[57] ABSTRACT

A printer comprising a printing mechanism, a housing for accommodating the printing mechanism, and a rotatable cover for opening and closing an opening in an upper surface of the housing. The cover has a small opening through which a single sheet of paper printed by the printing mechanism is dischargeable. A rotatable small cover is provided at the small opening for closing and opening the small opening. A receiver which receives the printed sheet of paper when the small cover is open is mounted removably.

3 Claims, 2 Drawing Sheets

PRINTER

BACKGROUND OF THE INVENTION

This invention relates to a printer such as a serial printer.

Prior Art

A printer such as a wire dot printer generally has an opening in an upper surface of an housing which accommodates printing means in order to exchange a ribbon cassette or facilitate setting of recording paper. The opening is opened and closed by a rotatable cover. When a single sheet of paper is used as a recording sheet in such printer, a paper feeder for the single sheet of paper is set on an upper surface of the housing and has a receiver which receives the sheet of printed paper.

This conventional printer has a complicated structure which mounts the sheet feeder and the sheet receiver on the upper housing surface and requires considerable space. Especially, the cut-paper feeder and the printed-paper receiver protrude high above the upper housing surface, so that the operability is low and a large opening is formed necessarily at the upper housing surface through which printing noise escapes to the outside.

It is an object of the present invention to reduce the escape of printing noise as much as possible when a printed-paper receiver is used.

It is another object of the present invention to reduce the height of the receiver protruding from the upper surface of the housing and the space in which the receiver is installed.

SUMMARY OF THE INVENTION

Under the above objects, the present invention comprises a printer comprisng a printing mechanism, a housing for accommodating the printing mechanism, and a rotatable cover for opening and closing an opening in an upper surface of the housing, characterized in that the cover has a small opening through which a single sheet of paper printed by the printing mechanism is dischargeable and that a rotatable small cover is provided at the small opening for closing and opening the small opening, and a mounting means for removably mounting a receiver which receives the printed sheet of paper when the small cover is open.

EMBODIMENT

Figure 1:
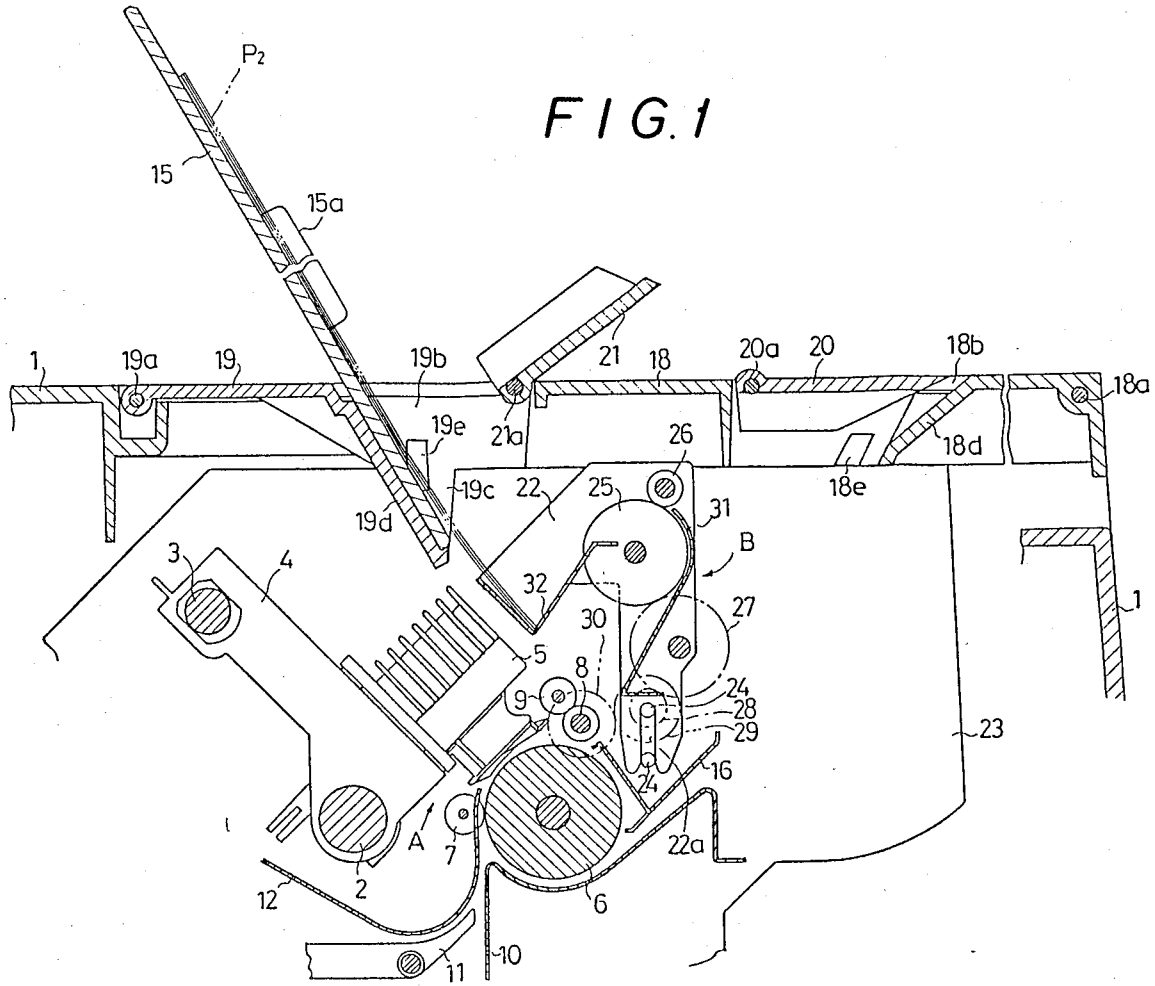
FIGS. 1 and 2 are partially omitted cross section views illustrating different states of a printer according to the present invention.

In FIG. 1, a printing mechanism A having the following structure is disposed within a housing 1. In this embodiment as an example, the printing mechanism A includes a carriage 4 supported slidably by guide shafts 2 and 3, a printing head 5 mounted on the carriage 4, and a platen 6 disposed so as to face the front end portion of the head 5. A pinch roller 7 is biased resiliently against the outer periphery of platen 6, and a paper feed roller 8 and a pinch roller 9 are disposed slightly above printing head 5. Platen 6 and feed roller 8 are driven in geared relationship to a paper feed roller (not shown). Paper guides 10, 11 and 12 are disposed around platen 6.

A sheet of unprinted paper P1 is fed by a paper feeder (not shown), for example, in the direction of arrow 13 between platen 6 and pinch roller 7, between platen 6 and printing head 5, and between feed roller 8 and pinch roller 9 and in the direction of arrow 14, and a sheet of paper P2 printed by printing head 5 is stocked in a paper receiver 15.

The lower side of the printed sheet P2 stacked in the receiver 15 is received by a lower-side receiver 16.

The upper structure of the housing 1 which accommodates the printing mechanism A will now be described.

A large opening 17 is provided in an upper surface of housing 1 to exchange an ink ribbon cassette (not shown) therethrough. The opening 17 is opened and closed by a first cover 18 and a second cover 19.

Cover 18 is rotatable around shaft **18*a* with a small opening 18*b* provided in the intermediate portion of cover 18 to discharge a sheet of printed paper P2. A small cover 20 is provided at the opening 18*b* so as to be rotatable around a shaft 20*a*. A pair of opposed side walls 18*c* (only one of which is visible in the drawings) partition the opening space 18*b* and has a protruding mounting means 18*e* which removably mounts each of both side edges of paper receiver 15 in cooperation with side wall 18*d*. The depth to which the paper receiver 15 is inserted is restricted by paper guides 15*a*, one formed on each side edge of the paper receiver 15**.

Therefore, when the paper receiver 15 is mounted on cover 18 as shown in FIG. 1 for using purposes, a single sheet of printed paper P2 is stacked with its printed surface facing outward (namely, in the direction opposite to that in which the paper receiver 15 is positioned) as shown by chain lines.

The structure of cover 19 is substantially identical to that of cover 18. The cover 19 is rotatable around shaft **19*a* and has a small opening 19*b* (see FIG. 2) provided at its end in order to discharge a single sheet of printed paper P2 through opening 19*b*. A small cover 21 is provided rotatable around shaft 21*a* at small opening 19*b*. A pair of opposed side walls 19*c* (only one of which is visible in the drawings) partition the small opening space 19*b* and has protruding mounting means 19*e* which mounts paper receiver 15 at each side edge of the receiver removably in cooperation with side wall 19*d*. The depth to which the paper receiver 15 is inserted is restricted by a protrusion 19*f* formed integrally with a lower end of side wall 19**.

Paper receiver 15 is also mountable between side wall **19*d* and mounting means 19*e* under a condition in which small cover 21 is open. It is to be noted that when paper receiver 15** is mounted like this, an auxiliary paper feed unit B which is prepared as an auxiliary device or optional device must be used.

Figure 2:
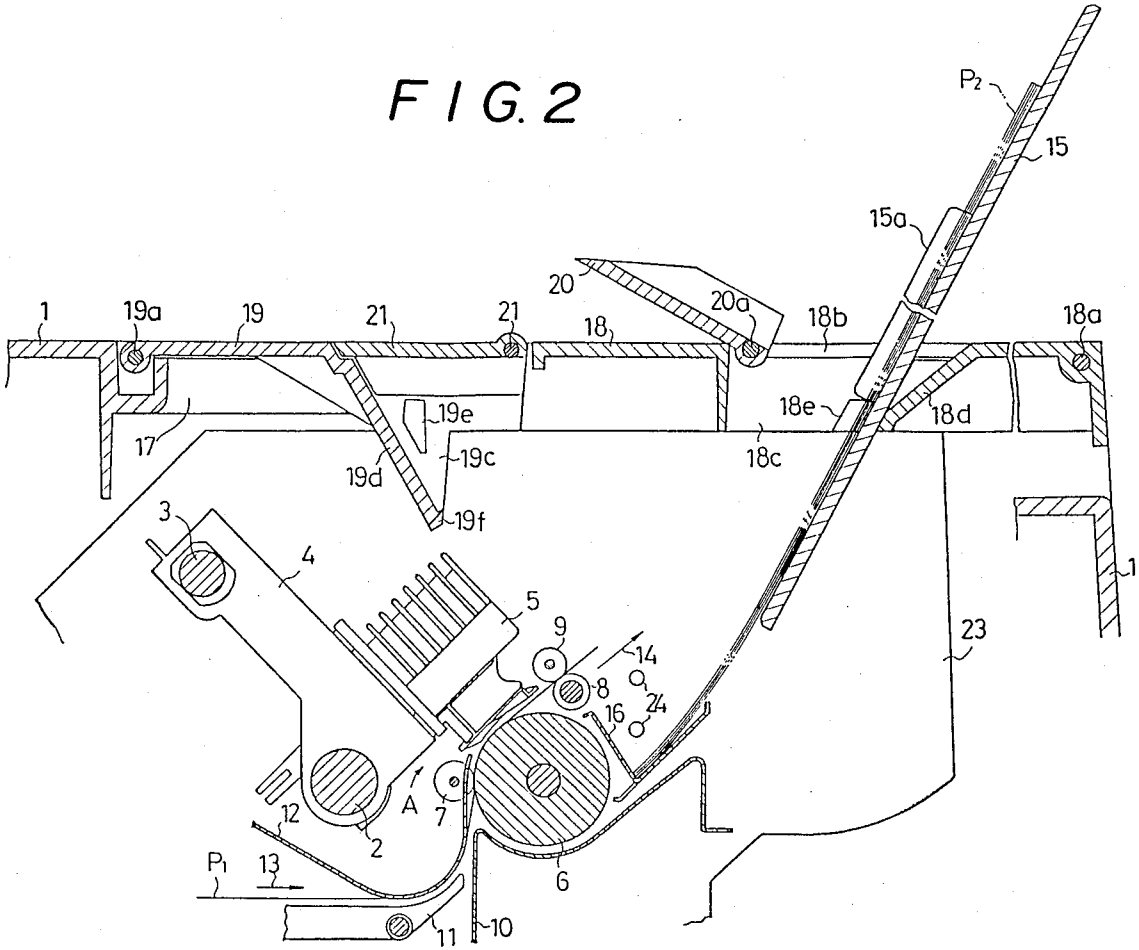

Auxiliary paper feed unit B has a pair of right and left side plates 22 (one of which is shown in FIG. 2) which each have at its lower end a groove **22*a* which removably receive a shaft 24 protruding from side plate 23 of the printing mechanism A. The pair of side plates 22 supports a paper feed roller 25, a pinch roller 26 and gear wheels 27–29 which drive feed roller 26. When this unit B is mounted as shown in FIG. 2, gear wheel 29 is arranged to mesh with a gear wheel 30 driven together with feed roller 8. Therefore, when platen 6 and feed roller 8 are driven by a paper feed motor (not shown), feed roller 25 of the unit B is driven in conjunction with roller 8. A paper guide 31 guides sheet of paper P2 which has passed between paper feed roller 8 and pinch roller 9 and between paper feed roller 25 and pinch roller 26. A lower-side receiver 32 receives a lower side of sheet P2 stacked in sheet receiver 15. Paper guide 31** and lower-side receiver 32 are fixed respectively to the side plates 22 of the unit B.

Therefore, under such condition, sheet of paper P2 which has passed between roller 8 and pinch roller 9 is fed between roller 25 and 26 via paper guide 31 and stacked on paper receiver 15, as shown by chain lines. At that time, sheet of printed paper P2 is stacked with its printed surface facing inward (paper receiver 15 side) and sheets of paper P2 are superposed page by page when page printing is performed.

When auxiliary paper feed unit B is mounted or removed, cover 18 can be opened. When an ink ribbon cassette (not shown) disposed behind the printing head 5 is exchanged, cover 19 can be opened. Therefore, these mounting, removing and exchanging operations are not impaired.

As described above in detail, according to the present invention, a small opening is provided in a cover on the upper housing surface, and the small opening is further covered by a small cover. In a state in which the small cover is opened, the sheet receiver is inserted into the housing through the small opening and supported removably by mounting means provided at the opening. Therefore, the opening area formed when the paper receiver is used is minimized and therefore the leakage of printing noise generated when the paper receiver is used is reduced. Since the paper receiver is inserted through the small opening into the housing, the height of the paper receiver protruding from the upper housing surface is reduced and the paper receiver is supported at the small opening, so that no space for support of the paper receiver is required.

We claim:

1. A printer comprising a printing mechanism, a housing for accommodating the printing mechanism, and a rotatable cover for opening and closing an opening in an upper surface of the housing, the improvement wherein:

the cover has a small opening therein through which a single sheet of paper printed by the printing mechanism is dischargeable; and a rotatable small cover provided at the small opening for closing and opening the small opening, and a mounting means for removably mounting a receiver which receives the printed sheet of paper when the small cover is open.

2. A printer according to claim 1, wherein there are two groups, each including the cover, the small opening, the small cover and the mounting means.

3. A printer according to claim 2, wherein one of the two groups receives the sheet of printed paper with the printed surface facing outward while the other of the two groups receives the sheet of printed paper with the printed surface facing inward.

* * * * *